US005433523A

United States Patent [19]

Grau

[11] Patent Number: 5,433,523

[45] Date of Patent: Jul. 18, 1995

[54] VIBRATORS

[75] Inventor: Thomas D. Grau, South Sioux City, Nebr.

[73] Assignee: International Pipe Machinery Corp., Sioux City, Iowa

[21] Appl. No.: 206,314

[22] Filed: Mar. 4, 1994

Related U.S. Application Data

[63] Continuation-in-part of Ser. No. 980,398, Nov. 23, 1992, Pat. No. 5,364,578.

[51] Int. Cl.[6] ..... B01F 11/00

[52] U.S. Cl. ..... 366/124; 74/87; 425/432; 425/456

[58] Field of Search ..... 366/120, 121, 122, 123, 366/124, 125, 126, 108; 425/432, 434, 427, 262, 456; 264/69, 71; 74/87

[56] References Cited

U.S. PATENT DOCUMENTS

| | | | |
|---|---|---|---|
| 3,036,658 | 5/1962 | Peterson . | |
| 3,096,556 | 7/1963 | Woods | 425/262 |
| 3,260,509 | 7/1966 | Rudy | 366/124 |
| 3,318,163 | 5/1967 | Matson . | |
| 3,733,163 | 5/1973 | Hermann | 425/262 |
| 3,822,054 | 7/1974 | Matson . | |
| 4,653,927 | 3/1987 | Wadensten | 366/125 |

OTHER PUBLICATIONS

Martin® Vibrotor® Vibrators; Martin Engineering Company brochure; Copyright 1990; Fischer International, Inc. External Concrete Vibrators brochure; (No Date).

Fischer International, Inc. External Concrete Vibrators brochure; (No Date).

*Primary Examiner*—Robert W. Jenkins

*Attorney, Agent, or Firm*—Baker & McKenzie

[57] ABSTRACT

An improved pneumatic vibrator configuration is provided. Specifically, the vibrator is annular in configuration which enables functional elements of adjacent components in a multi-component system to be passed through the vibrator. The configuration of the annular vibrator of the present invention conserves space in multi-component manufacturing systems.

11 Claims, 10 Drawing Sheets

Fig.1.
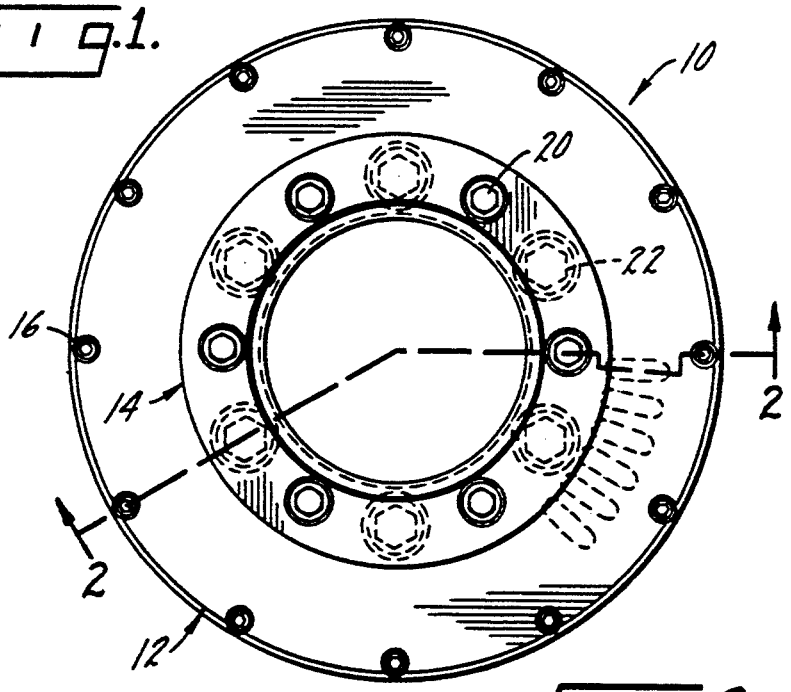
Fig.3.
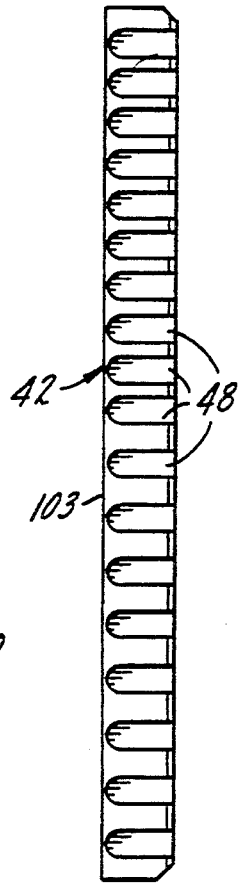
Fig.2.
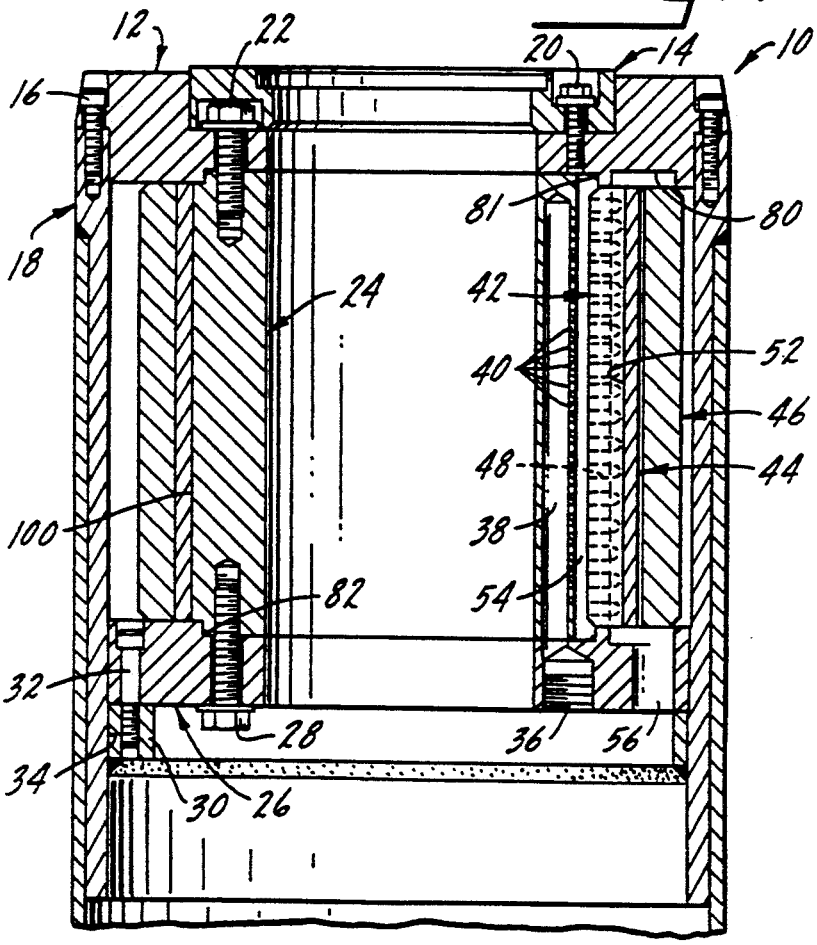
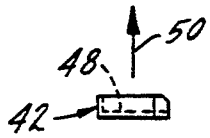
Fig.4.

14
71
72
11
11

14
72
71
12
13
80
78
76
13
74

76
12
74
81
78
80

15
26
84
36
38
86
15
56

84
82
86
26
38
36
56

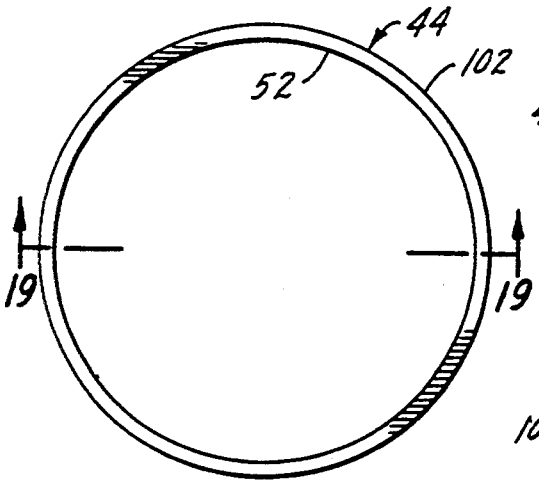
Fig. 18.
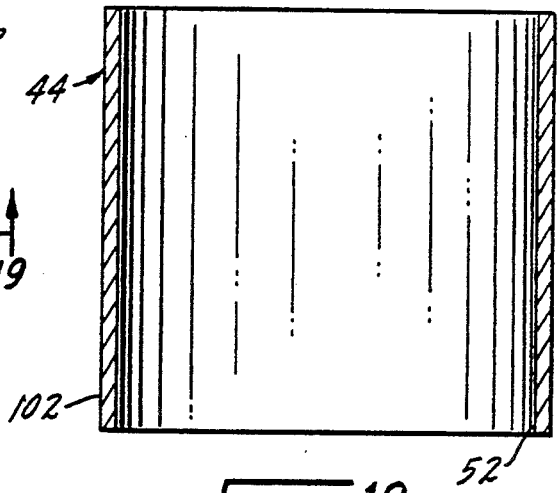
Fig. 19.
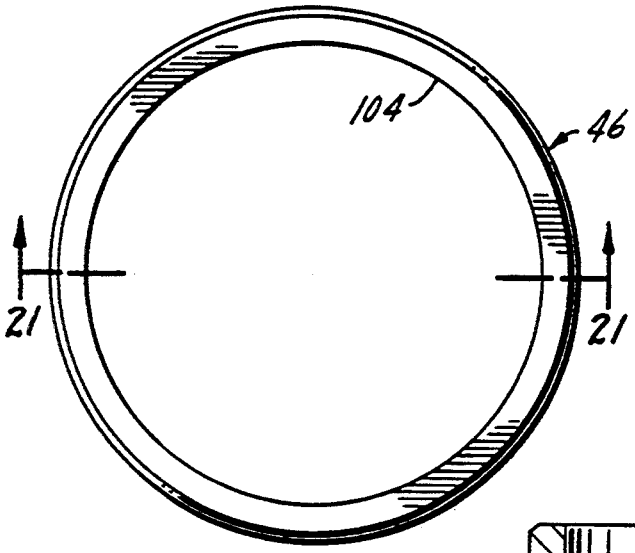
Fig. 20.
Fig. 21.
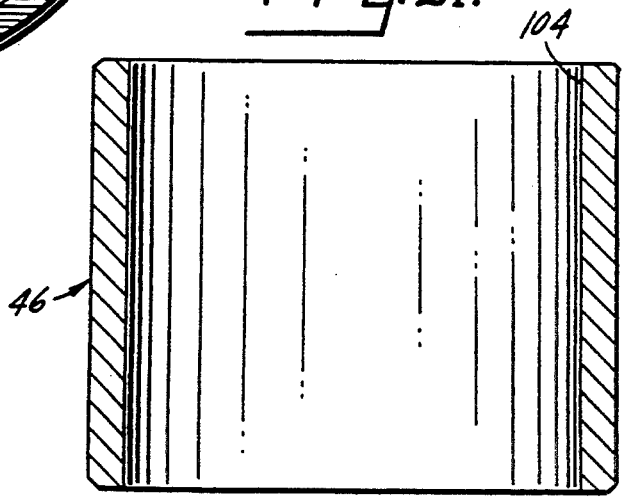

Fig. 22.
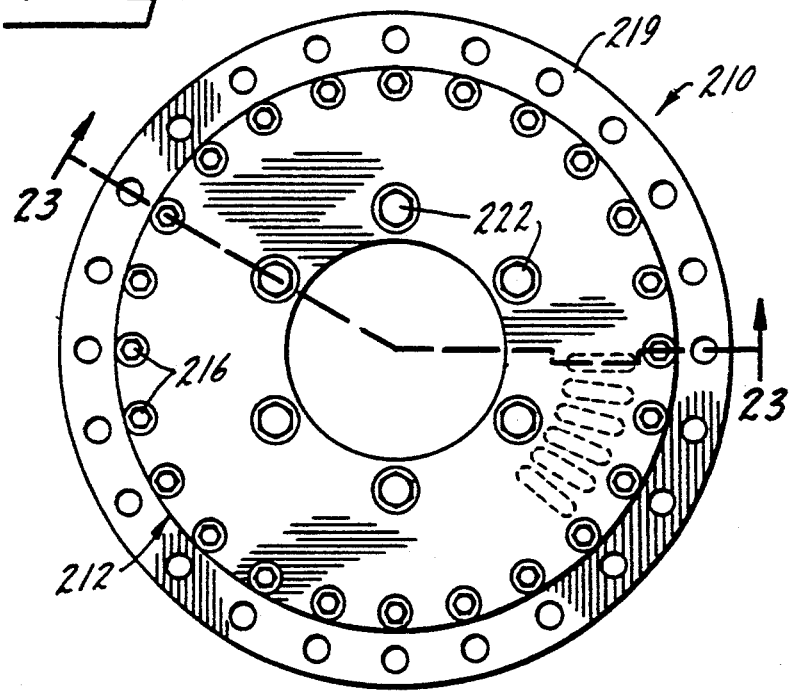
Fig. 24.
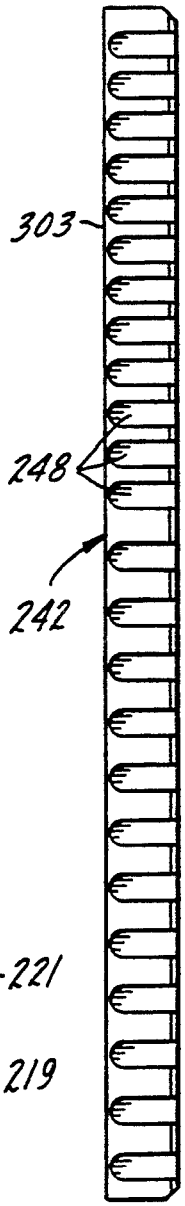
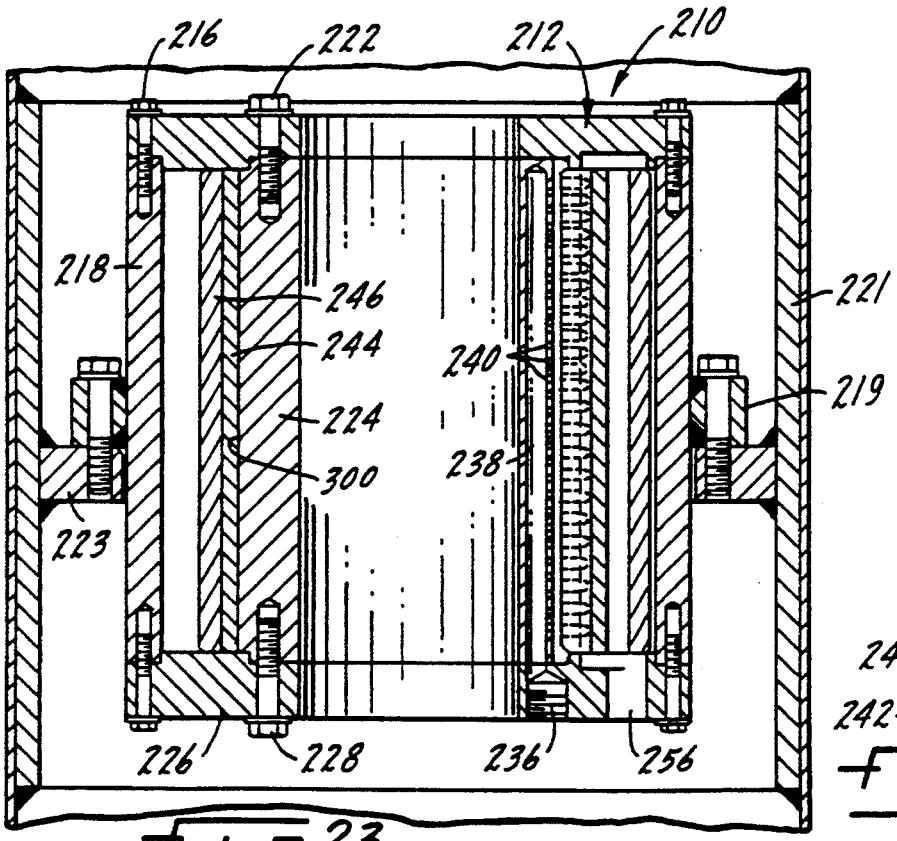
Fig. 23.
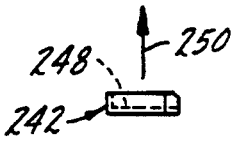
Fig. 25.

Fig. 35.
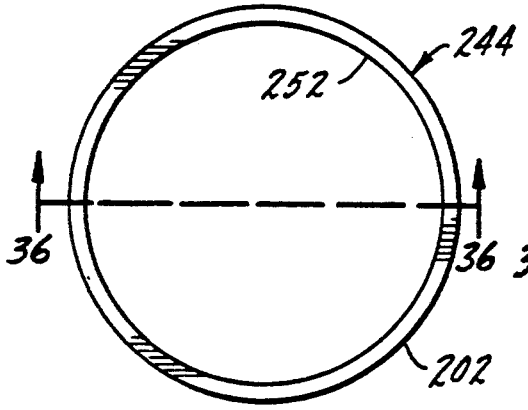
Fig. 37.
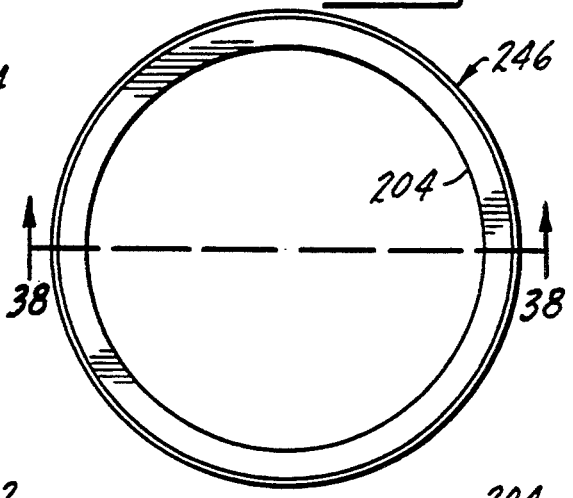
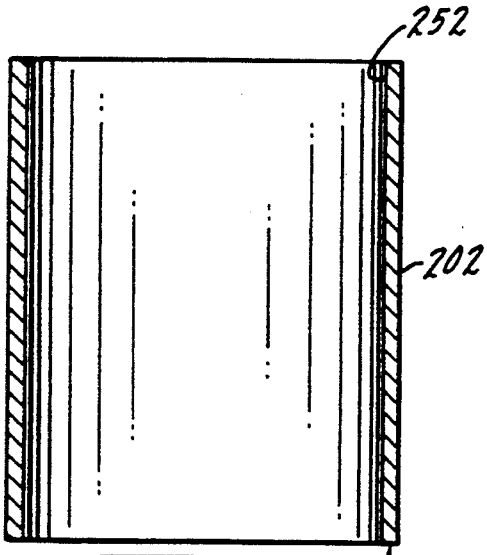
Fig. 36.
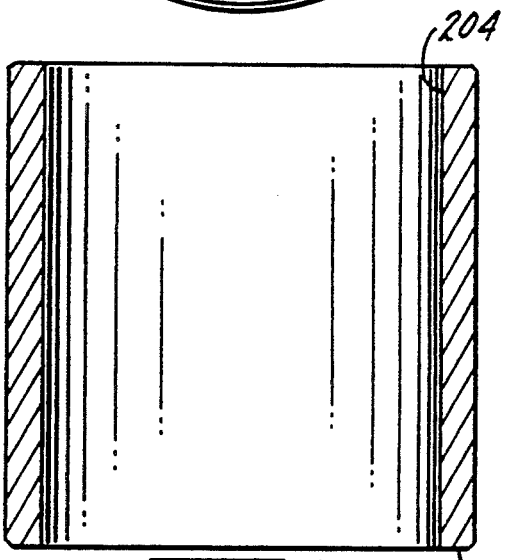
Fig. 38.
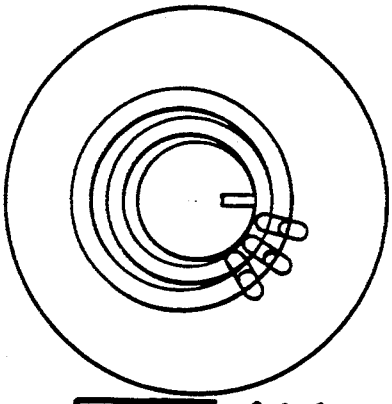
Fig. 40C.
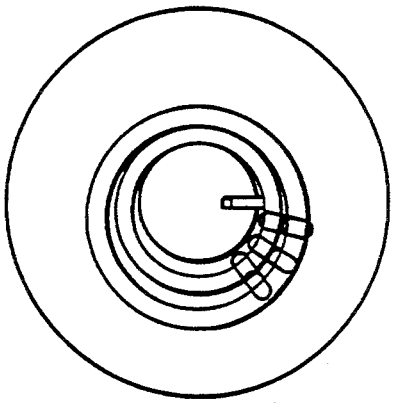
Fig. 40D.

Fig. 39A.
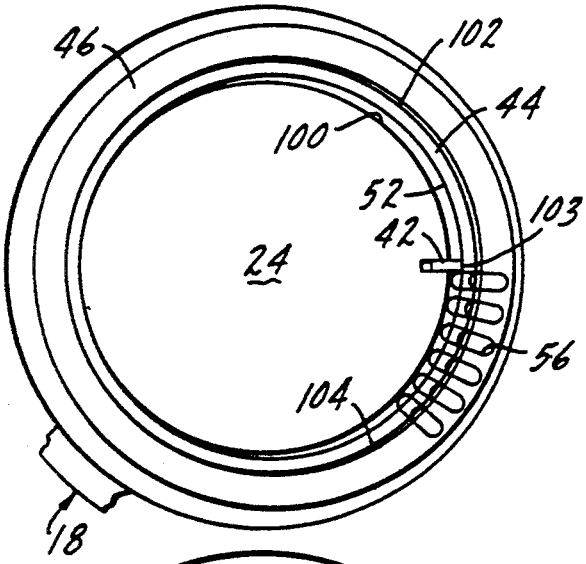
Fig. 39B.
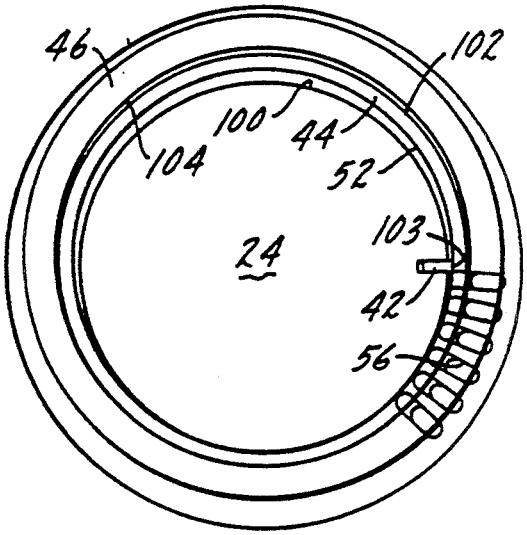
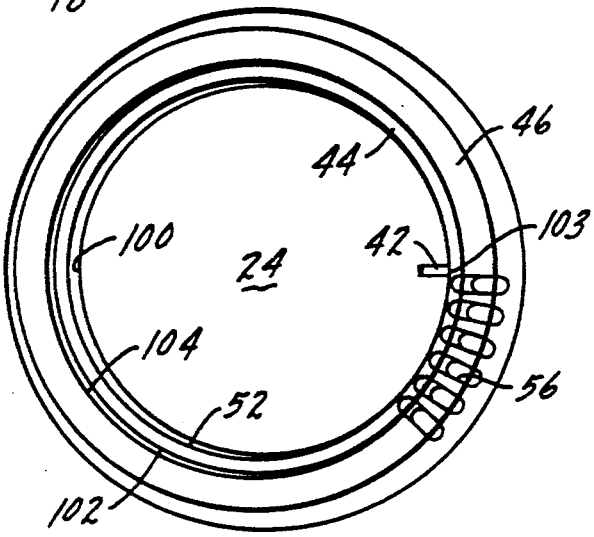
Fig. 39C.
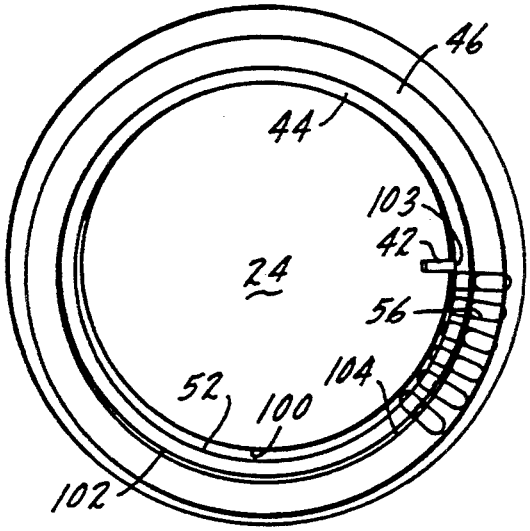
Fig. 39D.
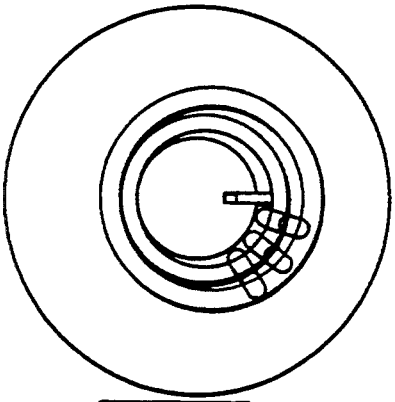
Fig. 40A.
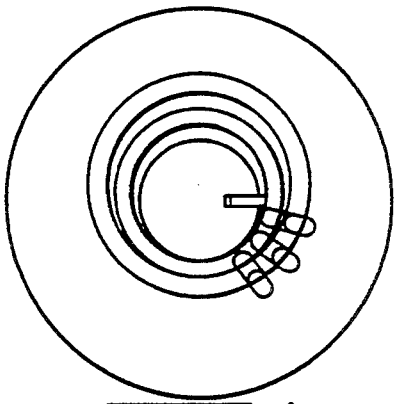
Fig. 40B.

VIBRATORS

This is continuation-in-part of application Ser. No. 07/980,398, filed Nov. 23, 1992, now U.S. Pat. No. 5,364,578.

This invention relates generally to improvements in vibrators used for all the purposes for which vibrators are currently employed including compacting, densifying, feeding, conveying and homogenizing. More particularly, this invention relates to an annularly configured vibrator that transmits vibrations radially outward through an outer core and includes a passageway through the axial center of the vibrator. The configuration of the vibrator enables the vibrator to be disposed within a large piece of equipment and further enables other functional elements of the equipment such as drive shafts, conduits or cables to be passed through the vibrator.

BACKGROUND OF THE INVENTION

Industrial vibrators have a wide variety of uses. Vibrators have been used in hoppers, bins and railcars to keep granular materials flowing as they should. Vibrators have also been used in connection with structural and architectural concrete because vibration of wet concrete helps consolidate the concrete for a stronger, more durable structure.

Although pneumatic vibrators came in a variety of embodiments the general type of vibrators to which the present invention is concerned supply air pressure through an inner, substantially cylindrical and solid shaft. Air passes through passageways in the shaft and engages a vane which directs the air substantially in one circumferential direction. The air, now proceeding in a substantially circular direction, engages an inner roller thereby causing the inner roller to rotate. The inner roller rotates in an eccentric orbit due to the presence of the vane which is disposed between the inner roller and the vibrator shaft. The inner roller is disposed within an outer roller and the rotating inner roller engages the outer roller thereby causing the outer roller to rotate eccentrically about the inner roller and shaft. The eccentric rotation of the inner and outer rollers about the shaft and within the vibrator body transmits vibrations radially outward through the outer roller and any structure associated therewith.

The primary drawback to this otherwise efficient design is the general configuration of the vibrator. The vibrator is cylindrical disc shaped in configuration which limits use of the vibrator in multi-component equipment. For example, during the construction of concrete pipe or concrete cylinders, it is highly desirable to apply vibration to the prepacked concrete. Further, it is highly preferable to vibrate the concrete immediately after it is packed with either a longbottom cylinder, a packerhead or a combination of the two. To vibrate the concrete immediately after it is packed, the vibrator should be disposed immediately below the packerhead. However, this configuration is not possible with many current disc shaped vibrator designs because the drive shaft for the packerhead or longbottom must be disposed below the packerhead or longbottom. Therefore, a cylindrical vibrator must be disposed below the drive shaft and drive mechanism of the packerhead or longbottom and, hence, substantially below the longbottom or packerhead. By contrast, an annularly configured vibrator could be disposed immediately below the packerhead because the drive shafting of a counter rotating packerhead assembly could be passed through the center of the vibrator thereby enabling the vibrator to be disposed in close proximity to the packerhead. Further, the drive shafting of a longbottom assembly could also be passed through the vibrator enabling the longbottom assembly to be disposed immediately above or below the vibrator, depending upon the design of the pipe making machinery.

Other applications of an annularly configured vibrator will be apparent to those skilled in the art. An annularly configured vibrator will have applications in the design of multi-component equipment or systems where the vibrator is but one component that must be disposed between or adjacent to other functional components. The primary benefit of such vibrators when used with other functional elements or parts of machinery or equipment is that the driving mechanism for the system can pass through the vibrator thereby providing greater flexibility to the designer of the equipment.

SUMMARY OF THE INVENTION

The present invention provides an annularly configured vibrator which includes an annular or ring-like top plate, an annular or ring-like bottom plate, and a hollow outer cylindrical vibrator body connected to the outer periphery of both the top plate and the bottom plate. A hollow, cylindrical vibrator shaft connects the inner periphery of the top plate to the inner periphery of the bottom plate. The vibrator shaft also provides fluid communication between a pressurized fluid supply and the annular space bound by the top and bottom plates and the body and shaft.

The annular space includes three primary components: a vane, an inner roller and an outer roller. Pressurized fluid enters the annular space through slots or ports disposed in the shaft and engages the vane which directs the pressurized fluid primarily in one circumferential direction. The vane also oscillates inward and outward and maintains contact with the inner surface of the inner roller. In the case of pressurized air, the air then engages the inner surface of the inner roller thereby causing the inner roller to rotate. The inner roller does not rotate in a circular orbit due to the engagement with the vane and the inward/outward oscillation of the vane and therefore the inner roller rotates eccentrically about the outside surface of the vibrator shaft. The outer roller is also cylindrical in configuration and begins to rotate upon engagement with the inner roller. The eccentric rotation of both the inner roller and the outer roller about the vibrator shaft imparts vibration outward through the vibrator body.

Pressurized fluid or pressurized air exits the annular space through slots disposed preferably in the bottom plate but the slots may also be disposed in the top plate or vibrator body.

In the preferred embodiment, the vane is fabricated from resilient yet pliable material whereby the vane maintains contact with the inside surface of the inner roller. The vane is held in place within a slot disposed in the vibrator shaft. Apertures extending from an air channel in the shaft communicate with the slot to provide fluid communication from the pressurized fluid supply through the slot and against the vane. The vane then will oscillate radially outward and direct the air flow in primarily one circumferential direction which initiates rotation of the inner roller. The engagement between the outer surface of the inner roller and the inner surface of the outer roller initiates rotation of the outer roller.

It is therefore an object of the present invention to provide an annularly configured vibrator having a central passage of a size sufficient to receive other operating and functional elements of the system in which the vibrator is incorporated, including central shafting.

Yet another object of the present invention is to provide an improved pneumatic vibrator as above described.

DETAILED DESCRIPTION OF THE DRAWINGS

This invention is illustrated more or less diagrammatically in the accompanying drawings, wherein:

FIG. 1 is a top plan view of a vibrator made in accordance with the present invention, particularly illustrating a plan view of the top plate;

FIG. 2 is a section view taken substantially along line 2—2 of FIG. 1;

FIG. 3 is a side plan view of the vane shown in FIG. 2 but vertically rotated 180° from its FIG. 2 position;

FIG. 4 is a end view of the vane shown in FIG. 3;

FIG. 18 is a plan view of the inner roller shown in FIG. 2;

FIG. 19 is a section view taken substantially along line 19—19 of FIG. 18;

FIG. 20 is a plan view of the outer roller shown in FIG. 2;

FIG. 21 is a section view taken substantially along line 21—21 of FIG. 20;

FIG. 22 is a top plan view of a second embodiment of a vibrator made in accordance with the present invention;

FIG. 23 is a section view taken substantially along line 23—23 of FIG. 22;

FIG. 24 is a side view of the vane illustrated in FIG. 23 but vertically rotated 180° from its FIG. 23 position;

FIG. 25 is an end view of the vane shown in FIG. 24;

FIG. 35 is an end view of the inner roller shown in FIG. 23;

FIG. 36 is a section view taken substantially along line 36—36 of FIG. 35;

FIG. 37 is an end view of the outer roller shown in FIG. 23;

FIG. 38 is a section view taken substantially along line 38—38 of FIG. 37;

FIGS. 39A through 39D illustrate the eccentrical orbit of the inner and outer rollers of the vibrators illustrated in FIGS. 2 and 23; and FIGS. 40A through 40D illustrate the eccentrical orbit of an inner and outer roller of an alternative embodiment of the vibrator of the present invention.

Figure 5:
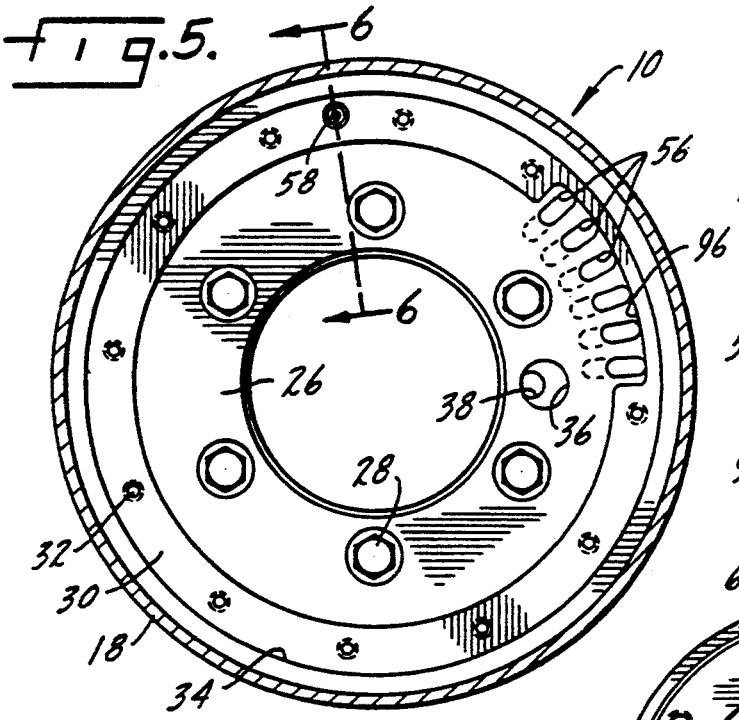
FIG. 5 is a bottom plan view of the vibrator shown in FIG. 2 particularly illustrating the bottom plate thereof.

It should be understood that the drawings are not necessarily to scale and that the embodiments are sometimes illustrated by graphic symbols, phantom lines, diagrammatic representations and fragmentary views. In certain instances, details which are necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS

Like reference numerals will be used to refer to like or similar parts from Figure to Figure in the following description of the drawings.

Two embodiments of the present invention are illustrated in the drawings, specifically at FIGS. 1 through 21 and at FIGS. 22 through 38.

Turning first to FIG. 1, a top plan view of a vibrator 10 is illustrated, particularly illustrating the top plate, indicated generally at 12, and the bearing, indicated generally at 14. Referring collectively to FIGS. 1 and 2, the cap screws indicated at 16 are used to affix the top plate 12 to the vibrator body indicated generally at 18. The cap screws 20 are used to attach the bearing 14 to the top plate 12 and then the cap screws shown at 22 are used to attach the top plate 12 and bearing 14 to the vibrator shaft indicated generally at 24.

Still referring to FIG. 2, the bottom plate indicated generally at 26 is attached to the vibrator shaft 24 with the cap screws 28. The bottom plate 26 is then attached to the ring 30 with the cap screws indicated at 32. The ring 30 is attached to the inside surface 34 of the vibrator body 18.

Still referring to FIG. 2, the vibrator shaft 24 provides fluid communication between the port 36 which is in communication with the pressurized fluid supply (or pressurized air supply) and the annular space defined by the top plate 12, bottom plate 26, shaft 24 and body 18. Air enters the port 36 and proceeds up through the conduit or channel 38 in shaft 24. A plurality of apertures 40 spaced along the channel 38 direct the air flow against the vane indicated generally at 42 which reciprocates in slot 54, see FIG. 8. As will be discussed below, the vane 42 directs the air flow against the inner roller, indicated generally at 44, thereby causing it to rotate and engage the outer roller, indicated generally at 46, causing it to rotate. The eccentric rotation of the inner roller 44 and outer roller 46 about the vane 42 and shaft 24 results in vibrational energy being transmitted outward through the vibrator body 18.

Turning to FIG. 3, the vane 42 features a plurality of slots indicated generally at 48. Air proceeds through the apertures 40 (see FIG. 2) and engages the slots before it is directed outward generally in the direction of the arrow 50 (see FIG. 4) where it engages the inside surface 52 (see also FIG. 19) of the inner roller 44. The placement of the slots 48 along the vane 42 as shown in FIG. 3 reflects the variances in the air pressure along the height of the conduit 38 (see FIG. 2). Specifically, as air enters through the port 36 and proceeds up through the conduit 38, the air pressure along the conduit 38 will vary. The spacing of the slots 48 along the vane 42 and the spacing of the apertures 40 along the conduit 38 reflect the variances in pressure along the height of the conduit 38 and are spaced to distribute the air pressure evenly against the inside surface 52 of the roller 44 to efficiently begin the rotation of the roller 44. The vane is received in the slot 54 disposed in the shaft 24 (see FIG. 7). Air is released from the annular space that contains the rollers 44, 46 through the slots in the bottom plate 26 indicated at 56 (see FIGS. 2, 5 and 14).

Figure 6:
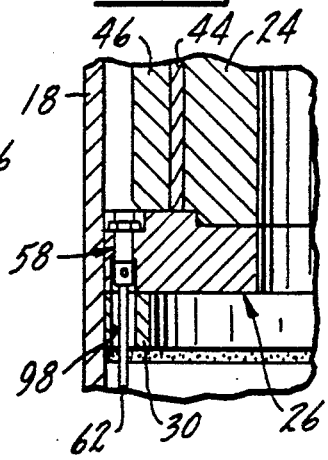
FIG. 6 is a partial section view taken substantially along line 6—6 of FIG. 5.

Turning to FIG. 5, the bottom plate 26 is attached to the ring 30 via the cap screws 32 and the ring 30 is welded or otherwise attached to the inside surface 34 of the vibrator body 18. As noted above, the slots indicated generally at 56 release the air or pressurized fluid from the vibrator 10. The bottom plate 26 may also accommodate a proximity switch indicated generally at 58 which may shut the vibrator off in the event an object engages the undersurface 60 of the ring 30 or, as shown in FIG. 6, if an object engages the probe 62 which extends downward from the proximity switch 58 through the ring 30.

Figure 8:
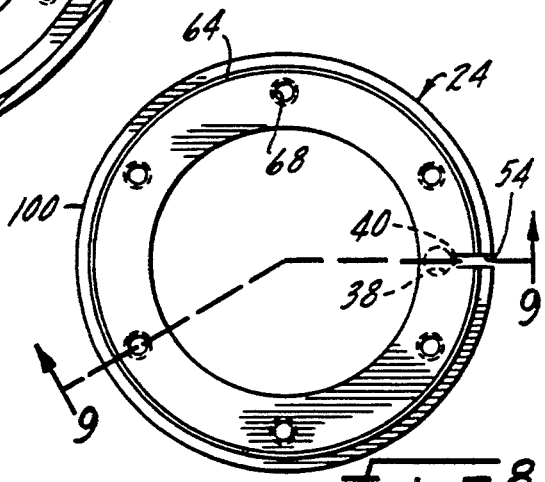
FIG. 8 is an end view of the vibrator shaft shown in FIG. 7.
Figure 7:
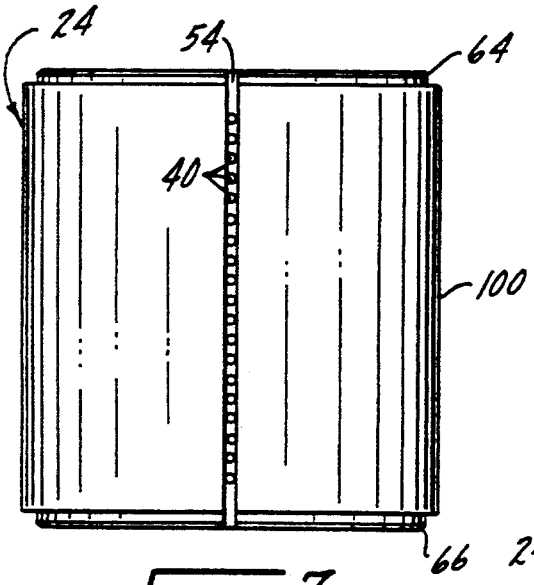
FIG. 7 is an elevation view of the vibrator shaft shown in FIG. 2.
Figure 9:
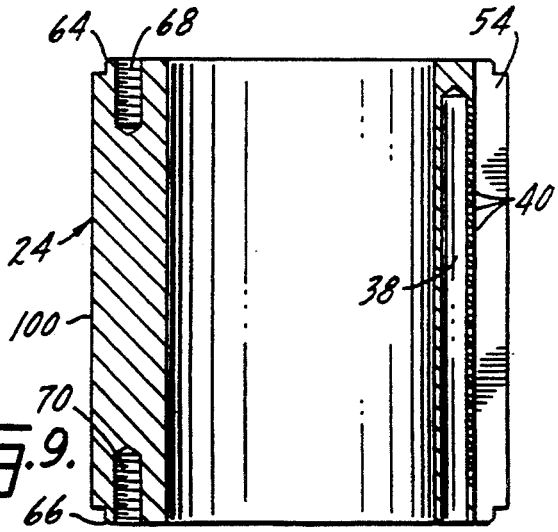
FIG. 9 is a section view taken substantially along line 9—9 of FIG. 8.

Turning now to FIGS. 7 through 9 collectively, the vibrator shaft 24 includes the beveled extensions 64, 66 that are received in the top plate 12 and bottom plate 26 respectively. The slot 54 receives the vane 42 and the apertures indicated at 40 direct pressurized fluid at the slots 48 of the vane 42 (see FIG. 3). The threaded holes 68 receive the cap screws 22 which attach the top plate 12 to the shaft 24. The holes 70 receive the cap screws 28 which attach the bottom plate 26 to the shaft 24.

Figures 10, 11, 12, 13, 14, 15:
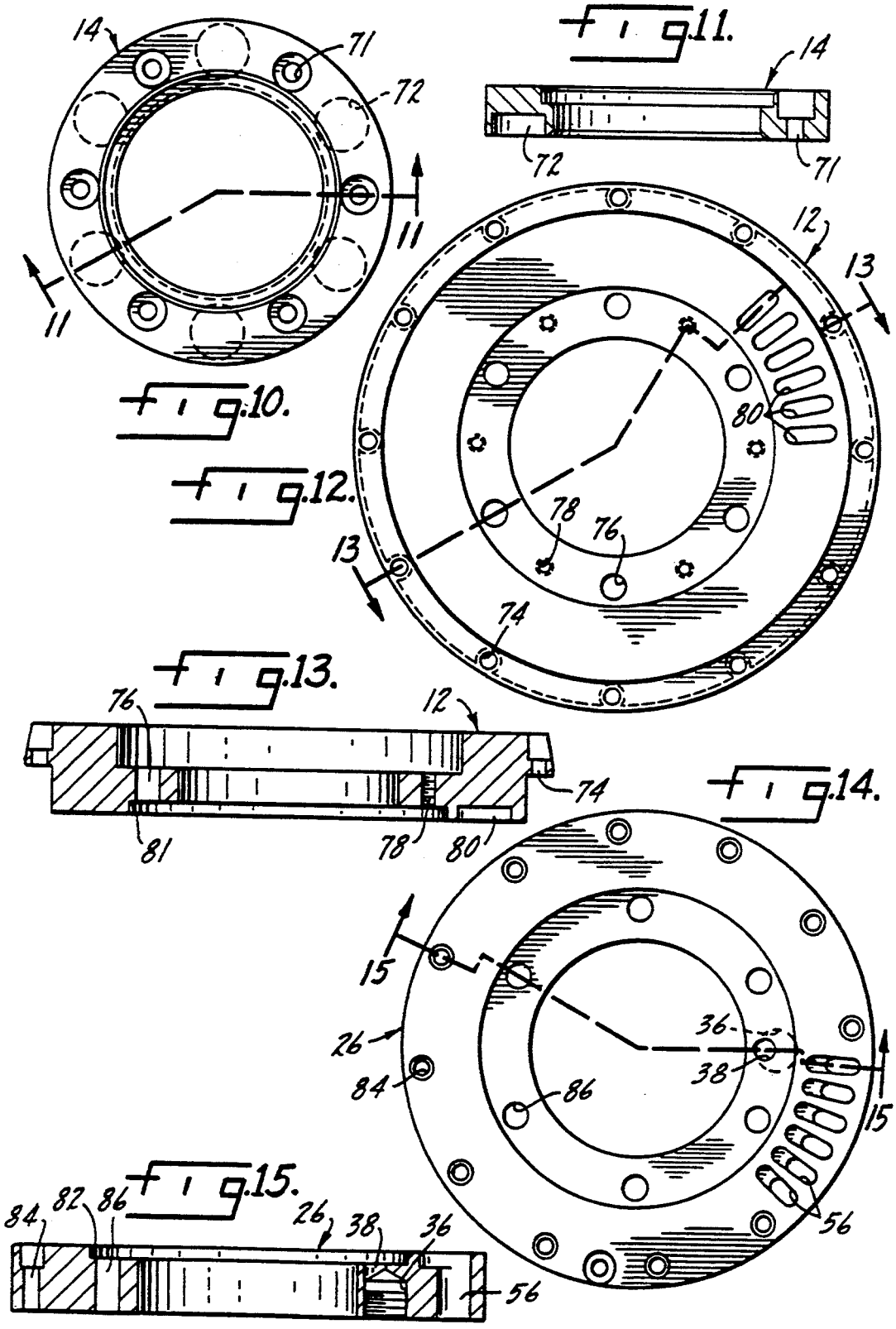
FIG. 10 is a top plan view of the bearing used in connecting the top plate to the vibrator shaft shown in FIG. 2.
FIG. 11 is a section view taken substantially along line 11—11 of FIG. 10.
FIG. 12 is a bottom plan view of the top plate shown in FIG. 1.
FIG. 13 is a section view taken substantially along line 13—13 of FIG. 12.
FIG. 14 is a bottom plan view of the bottom plate shown in FIG. 2.
FIG. 15 is a section view taken substantially along line 15—15 of FIG. 14.

The bearing 14 is illustrated in FIGS. 10 and 11. The holes 71 receive the cap screws 20 (see FIGS. 1 and 2) which attach the bearing 14 to the top plate 12. The slot 72 receives the head and washer of the cap screws 22 (see also FIGS. 1 and 2) which attach the top plate 12 to the vibrator shaft 24.

Turning to FIGS. 12 and 13, the holes 74 of the top plate 12 receive the cap screws 16 that attach the top plate 12 to the upper end of the vibrator body 18. The holes 76 receive the cap screws 22 that attach the top plate 12 to the vibrator shaft 24. The holes indicated at 78 receive the cap screws 20 that attach the bearing 14 to the top plate 12. The top plate 12 also includes plurality of slots or channels 80 that increase the turbulence of the air or fluid flow in the annular space defined by the shaft 24, top plate 12, bottom plate 26 and body 18. As seen in FIG. 13, the slots 80 do not pass through the top plate 12. In contrast, the slots 56 disposed in the bottom plate 26 (see FIG. 14) pass through the bottom plate 26 and not only increase the turbulence of the air flow in the annual space but also act to release air or fluid pressure from the vibrator 10.

Returning to FIG. 13, the beveled upper end 64 of the shaft 24 is accommodated in the recess 81 of the top plate. Similarly, the beveled lower end 66 of the shaft 24 is accommodated in the recess 82 disposed in the bottom plate as shown in FIG. 15. Referring to FIGS. 14 and 15, the bottom plate includes a plurality of holes 84 to accommodate the cap screws 32 which attach the bottom plate to the ring 30 (see FIG. 2). The bottom plate also includes the plurality of holes indicated generally at 86 that accommodate the cap screws 28 which attach the bottom plate 26 to the vibrator shaft 24.

Figure 17:
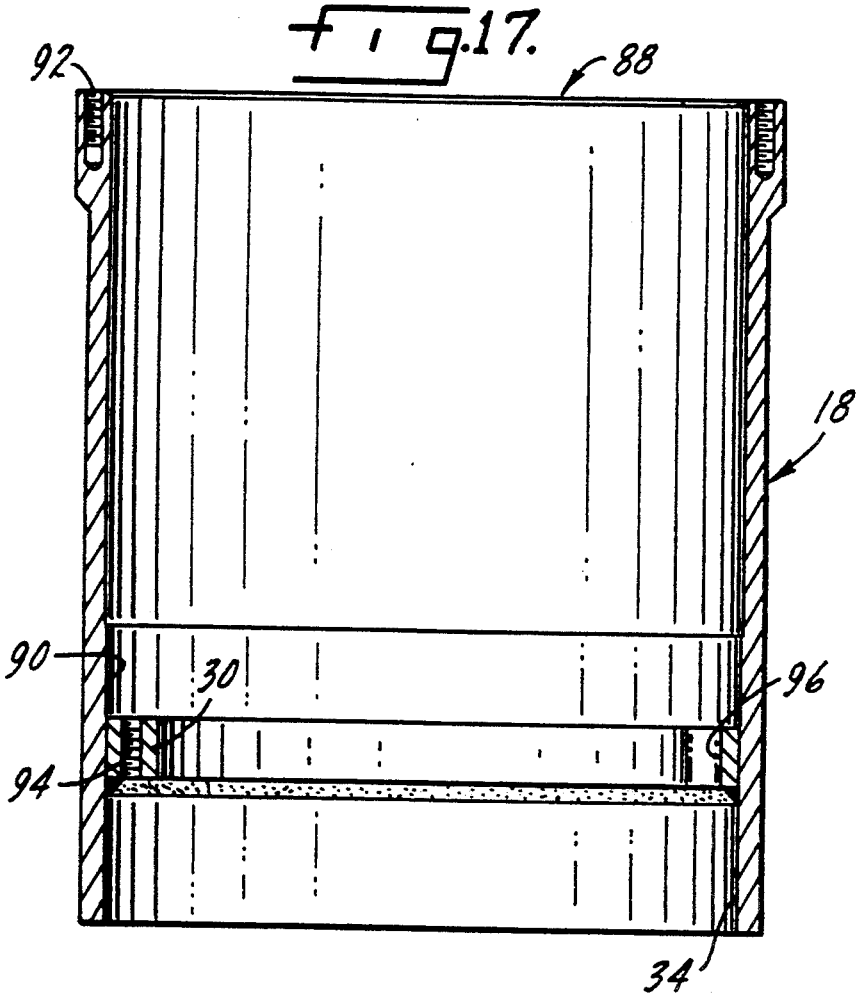
FIG. 17 is a section view taken substantially along line 17—17 of FIG. 16.
Figure 16:
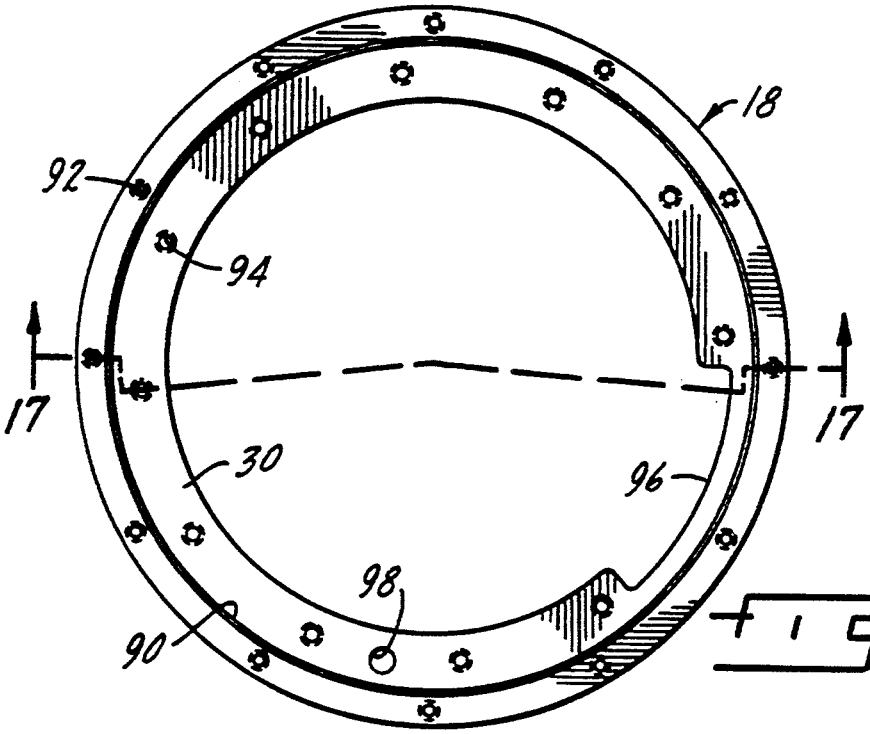
FIG. 16 is a top plan view of the vibrator body shown in FIG. 2.
Figure 26:
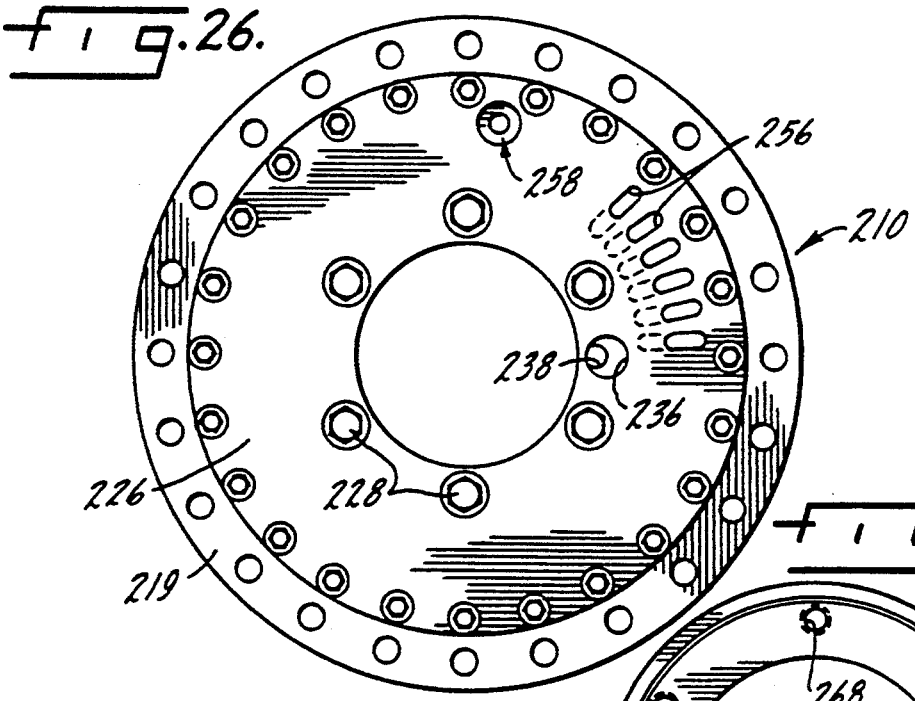
FIG. 26 is a bottom plan view of the vibrator shown in FIG. 23.
Figure 28:
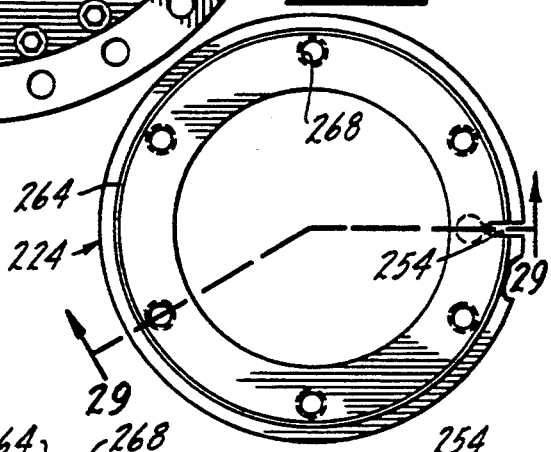
FIG. 28 is an end view of the vibrator shaft shown in FIG. 27.
Figure 27:
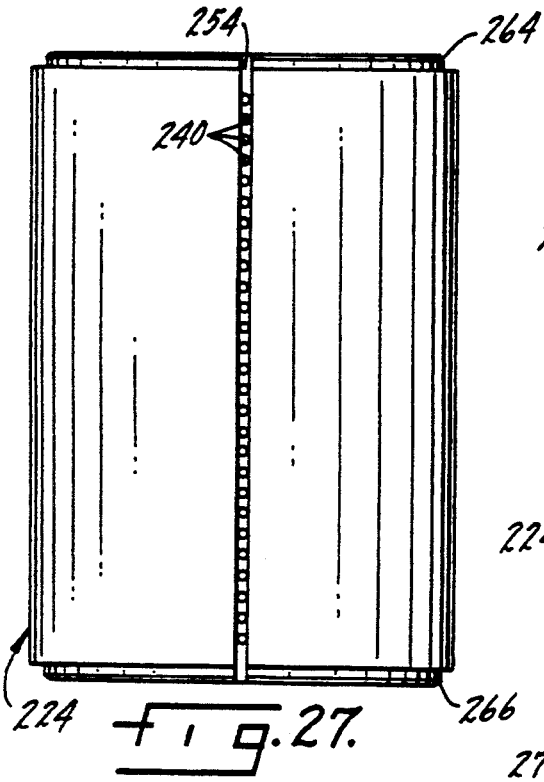
FIG. 27 is an elevation view of the vibrator shaft shown in FIG. 23.
Figure 29:
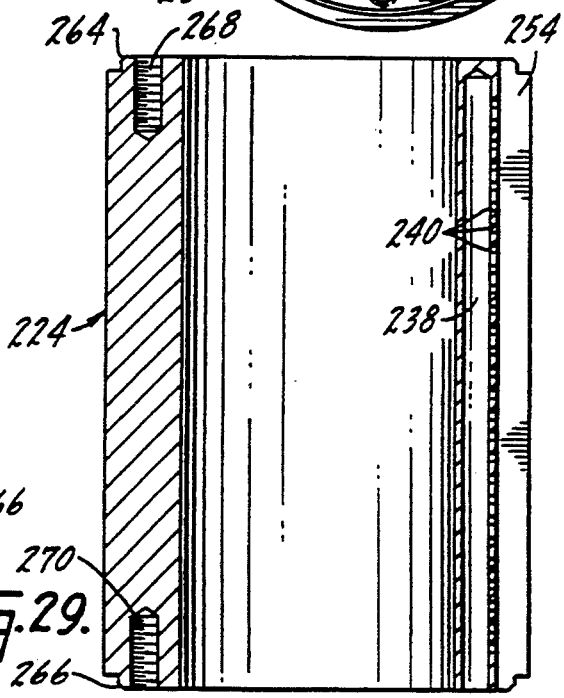
FIG. 29 is a section view taken substantially along line 29—29 of FIG. 28.
Figure 30:
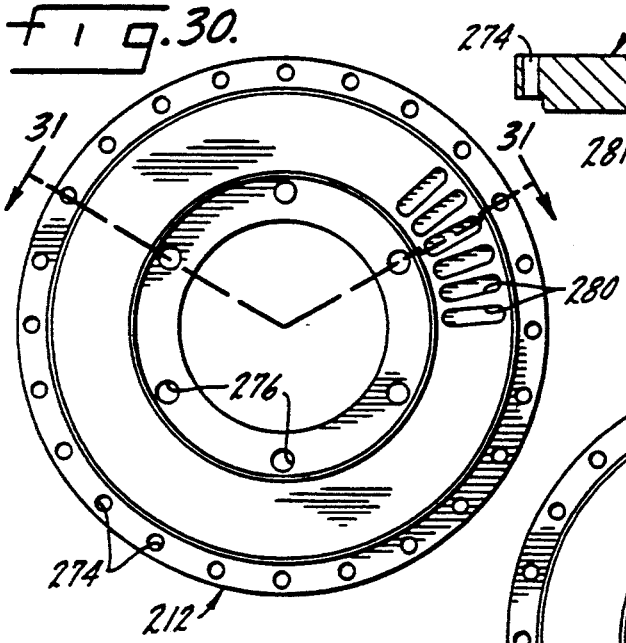
FIG. 30 is a bottom plan view of the top plate shown in FIG. 22.
Figure 31:
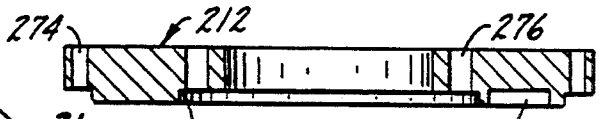
FIG. 31 is a section view taken substantially along line 31—31 of FIG. 30.
Figure 32:
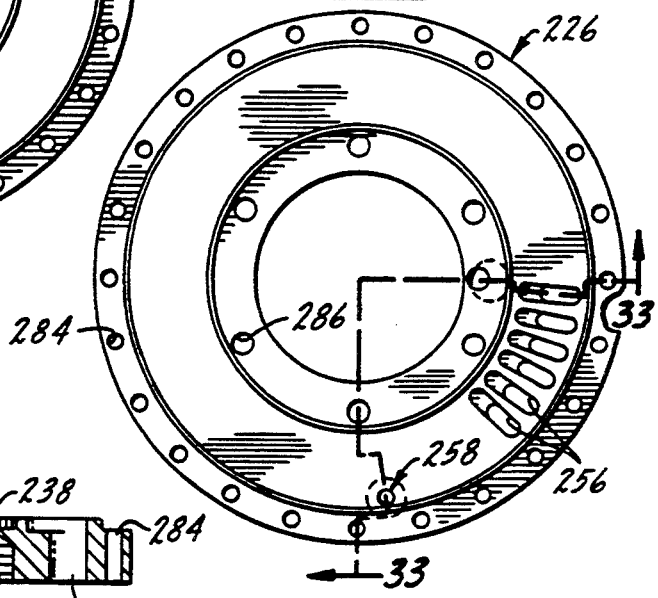
FIG. 32 is a top plan view of the bottom plate shown in FIG. 23.
Figure 33:
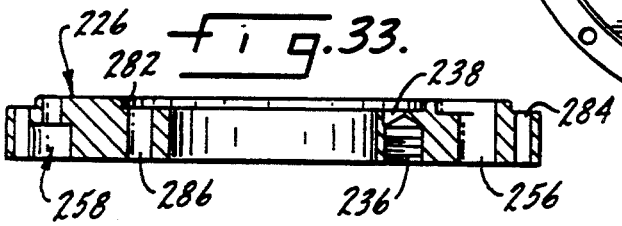
FIG. 33 is a section view taken substantially along line 33—33 of FIG. 32.
Figure 34:
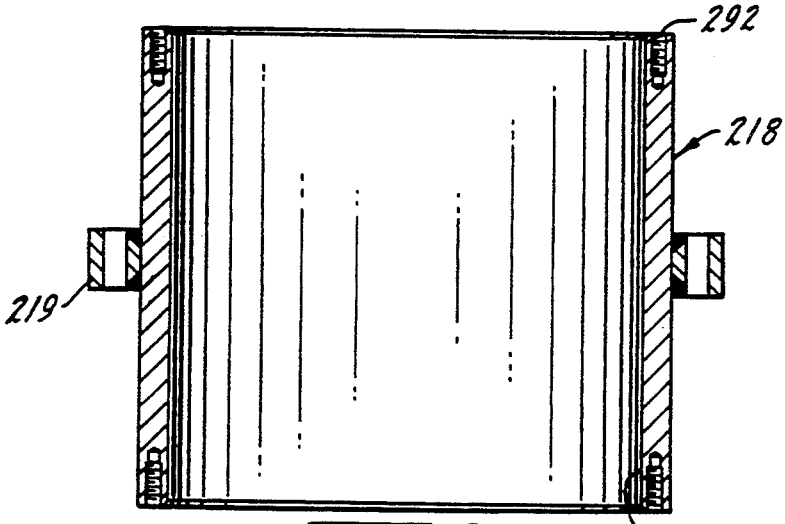
FIG. 34 is a vertical section view of the vibrator body shown in FIG. 23.

The vibrator body is illustrated in FIGS. 16 and 17. The ring 30 is welded or otherwise fixedly attached to the inside surface 34 of the vibrator body 18. Accordingly, the vibrator bottom plate is inserted down through the upper end 88 of the vibrator body 18 before it is accommodated in the recess 90. The holes indicated at 92 accommodate the cap screws 16 as shown in FIG. 2. The holes indicated at 94 accommodate the cap screws 32 which fixedly attach the bottom plate 26 to the ring 30. The recess 96 disposed in the ring 30 is in alignment with the air-release apertures or slots 56 disposed in the bottom plate 26. The hole 98 disposed in the ring 30 accommodates a downwardly extending probe 62 of a proximity sensor 58 (see FIG. 6).

The inner roller 44 and outer roller 46 are illustrated in FIGS. 18 through 21. As seen in FIGS. 18 and 20, the inner roller 44 is thinner and less bulky than the outer roller 46. Accordingly, in operation, air or pressurized fluid engages the inside surface 52 of the inner roller 44 and the inner roller 44 starts to rotate. Then, the outside surface 102 of the inner roller engages the inside surface 104 of the outer roller 46. Because the movement of the inner roller 44 is initiated by pressurized air or fluid, it is preferable to employ a relatively light inner roller 44 which, in turn, initiates the movement of the heavier outer roller 46.

Turning now to FIGS. 39A through 39D, the rotation of the rollers 44, 46 is illustrated. Referring first to FIG. 39A, the outside edge 103 of the vane 42 engages the inside surface 52 of the inner roller 44. Air engages the slots 48 in the vane 42 and is thereafter directed in the counterclockwise direction as shown in FIG. 39A. Turning to FIG. 39B, the air pressure coming off of vane 42 causes the inner roller 44 to rotate in the counterclockwise direction as shown by the gap between the inner surface 52 of the inner roller 44 and the outside surface of the vibrator shaft shown at 100. As seen in FIGS. 39C and 39D, the inner roller 44 continues to rotate about the outside surface 100 of the shaft 24 and the vane 42 oscillates from the fully extended position as shown in FIG. 39A to a collapsed position as shown in FIG. 39C. The engagement between the outside surface 102 of the inner roller 44 and the inside surface 104 of the outer roller 46 causes the outer roller 46 to rotate in the counterclockwise direction. The engagement between the outer edge 103 of the vane 42 and the inner surface 52 of the inner roller 44 causes the inner roller 44 to rotate in an eccentric fashion. In other words, the inner roller 44 does not rotate about a single axis due to the engagement between the inner roller 44 and the oscillating vane 42. Consequently, the outer roller 46 also rotates in an eccentric fashion. The irregular or eccentric rotations of the inner roller 44 and outer roller 46 cause intense vibrations which are transmitted outward through the vibrator body 18. A similar oscillation is illustrated with respect to smaller rollers and an alternative embodiment in FIGS. 40A through 40D.

Turning now to FIGS. 22 through 38, an alternative embodiment is illustrated. The vibrator shown in FIGS. 22 through 39 is somewhat functionally similar to the vibrator 10 shown in FIGS. 1 through 21 and similar parts are identified with the same reference number with the prefix "2" (i.e., the top plate "212" as opposed to the top plate 12). In the embodiment of FIGS. 22 through 38, the vibrator 210 is consistently larger, and the bottom plate 226 is attached directly to the vibrator body 218 as opposed to the ring 30 as shown in FIG. 2. Further, the vibrator body 218 is equipped with an outer ring 219 as shown in FIG. 22 which is used to mount the vibrator 210 inside a core 221. The core 221 includes a ring 223. The core 221, in the example shown in FIG. 23, may be used in the fabrication of concrete pipe. The remaining functional elements of the vibrator 210 are similar or analogous to the functional elements described above with respect to the vibrator 10 shown in FIGS. 1 through 21.

One of the primary benefits provided by the annular configuration of the vibrators 10 and 210 is that functional parts such as drive shafts, cables or conduits can be passed through the vibrator which makes the vibrators 10 and 210 more useful as one component of a multi-component system. In other words, the designer of a multi-component system has greater flexibility in the design of the system because an entire section of the system need not be reserved for the pneumatic vibrator. The vibrator can be spaced closely between two other components and the functional elements such as drive shafts, conduits, cables, etc. of adjacent components can be passed directly through the vibrator.

Although only two embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

I claim:

1. An annularly configured vibrator comprising:
an annular top plate,
an annular bottom plate,
a vibrator body connecting an outer periphery of the top plate to an outer periphery of the bottom plate,
a vibrator shaft connecting an inner periphery of the top plate to an inner periphery of the bottom plate, the vibrator shaft providing fluid communication means between a pressurized fluid supply and an annular space bound by the top and bottom plates and the body and shaft,
an outer roller,
an inner roller disposed within the outer roller,
a vane carried by the shaft and disposed between the inner roller and the shaft,
the outer and inner rollers and the vane all being disposed in the annular space bound by the top and bottom plates and the body and shaft,
the fluid communication means being so disposed that pressurized fluid entering the annular space through the vibrator shaft presses against the vane, said pressurized fluid thereafter being directed in substantially one circumferential direction by the vane before engaging an inner surface of the inner roller,
the inner roller rotating in said one circumferential direction about the vibrator shaft and vane and engaging an inner surface of the outer roller,
the outer roller rotating in said one circumferential direction about the vibrator shaft, vane and inner roller.

2. The vibrator of claim 1,
wherein the vane includes an outer surface,
the outer surface of the vane maintaining sealing contact with the inner surface of the inner roller in all relative positions of the inner roller to the shaft,
the vane reciprocating forward and away from the shaft while maintaining sealing contact with the inside surface of the inner roller.

3. The vibrator of claim 2,
wherein the vibrator shaft includes at least one row of perforations extending from an upper end portion of the shaft to a lower end portion of the shaft,
said perforations being part of the fluid communication means,
the vane being disposed in an aligned and parallel relationship with the row of perforations.

4. The vibrator of claim 3,
wherein the perforations of the vibrator shaft pass through a slot disposed in an outer surface portion thereof, the vane being accommodated in the slot to maintain a tangential position of the vane while the inner roller oscillates.

5. The vibrator of claim 1,
wherein the bottom plate includes a proximity switch, the proximity switch being in communication with a control means, the control means terminating the flow of the pressurized fluid to the vibrator shaft when the proximity switch is activated by the presence of an object adjacent to the bottom plate of the vibrator.

6. An annularly configured vibrator comprising:
an annular top plate,
an annular bottom plate,
a cylindrical vibrator body connecting an outer periphery of the top plate to an outer periphery of the bottom plate,
a cylindrical vibrator shaft connecting an inner periphery of the top plate to an inner periphery of the bottom plate, the vibrator shaft including at least one row of vertically aligned perforations providing fluid communication between a pressurized fluid supply and an annular space bound by the top and bottom plates and the body and shaft,
means for releasing pressurized fluid from the annular space,
an outer cylindrical roller,
an inner cylindrical roller disposed within the outer cylindrical roller,
a vane disposed between the inner cylindrical roller and the shaft and in front of the perforations disposed in the shaft, an upper end of the vane being fixed to the top plate, a lower end of the vane being fixed to the bottom plate, the outer and inner cylindrical rollers and the vane all being disposed in the annular space bound by the top and bottom plates and the body and shaft, pressurized fluid entering the annular space through the perforations in the vibrator shaft passes against the vane, said pressurized fluid is directed in substantially one circumferential direction by the vane before engaging an inner surface of the inner roller, the inner roller rotating in said one circumferential direction about the vibrator shaft and engaging an inner surface of the outer roller, the outer roller rotating in said one circumferential direction about the vibrator shaft of the vibrator.

7. The vibrator of claim 6, wherein the vane includes an outer surface, the outer surface of the vane maintaining sealing contact with the inner surface of the inner roller, the vane oscillating inward and outward while maintaining sealing contact with the inside surface of the inner roller.

8. The vibrator of claim 7, the vane is disposed in a parallel relationship with the row of perforations disposed in the shaft.

9. The vibrator of claim 8, wherein the perforations of the vibrator shaft pass through a slot disposed in an outer surface thereof, the vane being accommodated in the slot to maintain a tangential position of the vane while the inner roller rotates.

10. The vibrator of claim 6, wherein the bottom plate includes a proximity switch, the proximity switch being in communication with a control means, the control means terminating the flow of the pressurized fluid to the vibrator shaft when the proximity switch is activated by the presence of an object adjacent to the bottom plate of the vibrator.

11. An annular vibrator comprising:

an annular top plate, an annular bottom plate, a vibrator body connecting an outer periphery of the top plate to an outer periphery of the bottom plate, a vibrator shaft connecting an inner periphery of the top plate to an inner periphery of the bottom plate, means for providing fluid communication between a pressurized fluid supply and an annular space bound by the top and bottom plates and the body and shaft, means for releasing pressurized fluid from the annular space, means for converting pressurized fluid in the annular space to vibrational movement therein, means for transmitting vibrational movement in the annular space through the vibrator body.

* * * * *